US006527375B2

(12) United States Patent
Kobayashi et al.

(10) Patent No.: US 6,527,375 B2
(45) Date of Patent: Mar. 4, 2003

(54) INK JET RECORDING DEVICE CAPABLE OF CONTROLLING IMPACT POSITIONS OF INK DROPLETS

(75) Inventors: Shinya Kobayashi, Hitachinaka (JP); Takahiro Yamada, Hitachinaka (JP); Kunio Satou, Hitachinaka (JP); Kazuo Shimizu, Hitachinaka (JP); Hitoshi Kida, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/002,106

(22) Filed: Dec. 5, 2001

(65) Prior Publication Data

US 2002/0075338 A1 Jun. 20, 2002

(30) Foreign Application Priority Data

Dec. 19, 2000 (JP) ..... 2000-385434

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

FOREIGN PATENT DOCUMENTS

| | | |
|---|---|---|
| JP | 47-7847 | 3/1972 |
| JP | 55-42836 | 3/1980 |
| JP | 2-62243 | 3/1990 |
| JP | 7-117241 | 5/1995 |

*Primary Examiner*—Raquel Yvette Gordon
(74) *Attorney, Agent, or Firm*—Whitham, Curtis & Christofferson, P.C.

(57) ABSTRACT

A single dot on a recording medium is formed by dots of a plurality of ink droplets ejected from different orifices 201 of a head 107. For example, four dots are formed overlapping one on the other to form a single dot. In order to suppress unevenness in ink density of a recording image due to undesirably shifted impact positions of these dots, impact positions of the dots for the single dots are shifted to the right and left on purpose by ¼-dot-worth of distance for each, that is, ½-dot-worth of distance in total. This printing method has a good effect on controlling noise element, which has a high special frequency and causes uneven ink density.

16 Claims, 11 Drawing Sheets

| ELECTRIC VOLTAGE Vchg (V) | DEFLECTION AMOUNT c (μm) | AVERAGE SPEED Vav (m/sec) |
|---|---|---|
| 200 | 187 | 2.45 |
| 100 | 94 | 2.49 |
| 0 | 0 | 2.46 |
| −100 | −94 | 2.38 |
| −200 | −187 | 2.42 |

FIG. 8(a)
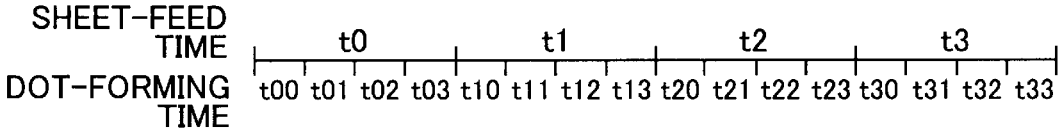
FIG. 8(b)
| ELECTRODE DATA 111 | R2 | R1 | L1 | L2 | R2 | R1 | L1 | L2 | R2 | R1 | L1 | L2 | R2 | R1 | L1 | L2 |
|---|---|---|---|---|---|---|---|---|---|---|---|---|---|---|---|---|
| X COORDINATE | 3 | 2 | 1 | 0 | 3 | 2 | 1 | 0 | 3 | 2 | 1 | 0 | 3 | 2 | 1 | 0 |
| Y COORDINATE | 0 | 0 | 0 | 0 | 1 | 1 | 1 | 1 | 2 | 2 | 2 | 2 | 3 | 3 | 3 | 3 |
| EJECTION DATA 111 | 1 | 1 | 1 | 1 | 1 | 1 | 1 | 1 | 1 | 1 | 1 | 1 | 1 | 1 | 3 | 1 |
FIG. 8(c)
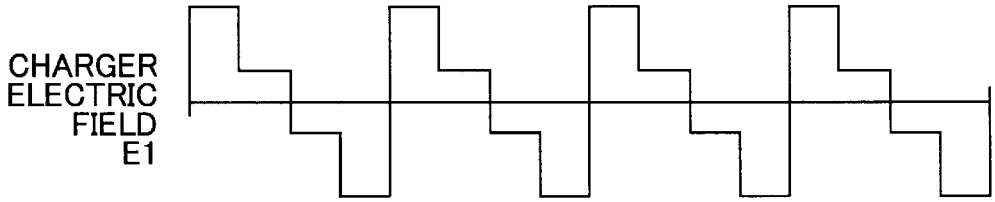
FIG. 8(d) FIG. 8(e) FIG. 8(f) FIG. 8(g)
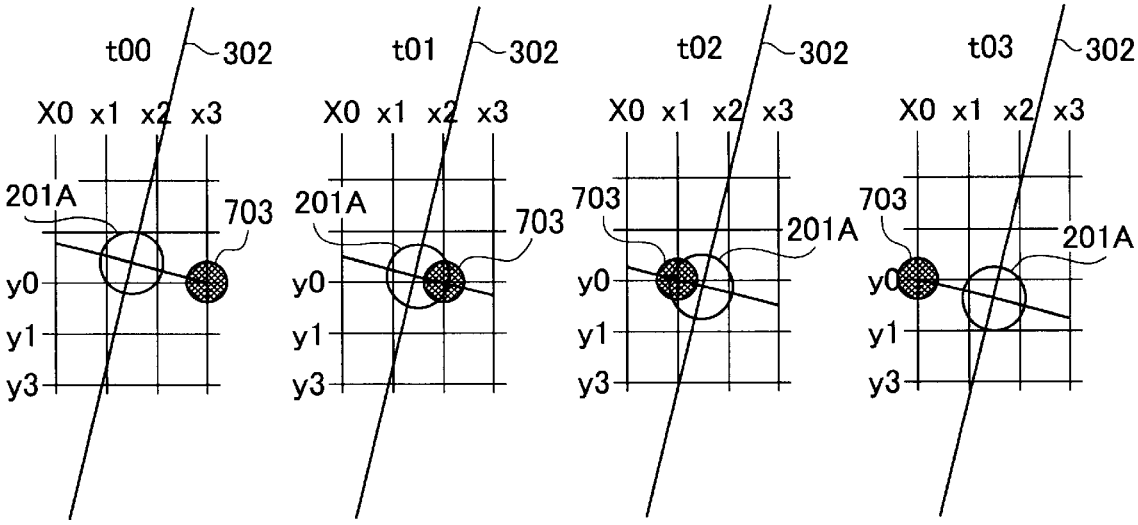

FIG.12(a)
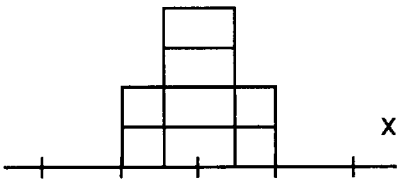
FIG.12(b)
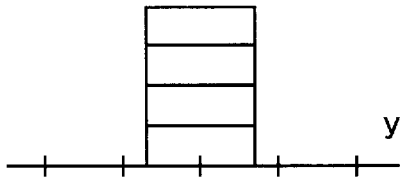
FIG.13(a)
FIG.13(b)
FIG.13(c)
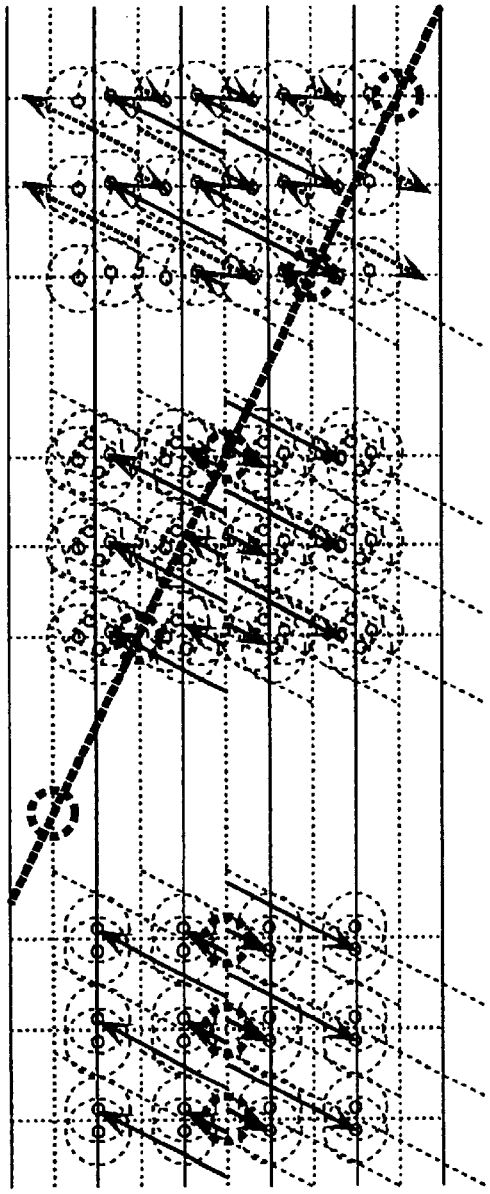

INK JET RECORDING DEVICE CAPABLE OF CONTROLLING IMPACT POSITIONS OF INK DROPLETS

BACKGROUND OF THE INVENTION

1. Field of the Invention

The present invention relates to a multi-nozzle ink jet recording device, wherein ink droplets are charged by a charger electric field at the time of ejection and deflected by a deflector electric field so as to control impact positions of the ink droplets, thereby providing a high quality image.

2. Description of the Related Art

As disclosed in Japanese Patent Publication No. SHO-47-7847, there has been proposed a conventional ink jet recording device wherein ink droplets, which are uniform in size and separated from one another, are ejected through nozzles in response to a print signal, charged by a charger electric field in accordance with the print signal, and deflected by a constant deflector electric field so as to either collect the ink droplets before impacting on a recording medium or control impact positions of the ink droplets on the recording medium. In order to improve the printing speed, a plurality of nozzles are arrayed.

In a serial printing type ink jet recording device, the process of the head to print while scanning across the recording medium and the feeding process to feed the recording sheet are repeatedly performed in alternation so as to from a complete image.

When there is uneven characteristic among the nozzles, ejected direction of ink droplets varies among the nozzles. This varies the impact positions of the ink droplets on the recording medium and results in uneven ink density on the image. Undesirable strips extending in the head scanning direction appear and image quality is degraded. In order to overcome this problem, a multipath printing method is used. That is, a print region that is printed in a single scan is overlapped with neighboring print regions, and dots on or near the same scanning line are formed by a plurality of nozzles in alternation during the scan and the subsequent scan. In this way, the variations in characteristics of the different nozzles will be cancelled out, and so the uneven ink density in the printed image is suppressed.

Arraying the nozzles is effective in improving printing speed. When the print head is elongated to have a width corresponding to the width of the recording medium, there is no need to scan the head across the recording sheet at all, and printing is performed while feeding the recording medium continuously. This type of printing is called line printing, and is excelling in printing speed. However, there are a number of problems to overcome before realizing the line printing type ink jet recording device.

One of the problems is the fact that the multipath printing method cannot be used in the line printing type ink jet recording device, because dots on a single scanning line in the sheet feed direction are formed only by a corresponding one of the nozzles. Therefore, if an impact position of ink droplets from any nozzle shifts from a target position, a distinct strip extending in the sheet feed direction appears in printed images. It is conceivable to align a plurality of heads in parallel in order to obtain the same effect as the multipath printing. However, this makes the recording device undesirably bulky and is not realistic way to solve the problem.

Japanese Patent-Application Publication Nos. SHO-55-42836, HEI-2-62243, and HEI-7-117241 proposes methods of solving the above problem, wherein a pseudo borderline is defined between the print regions allocated to the neighboring nozzles, which differs from an actual borderline. The pseudo borderline is in a saw shape, which has a certain amplitude and a repetition frequency. Because the adjacent print regions protrude and retract, the unevenness in ink density can be less recognizable.

However, usually the resolution at the border degrades in the conventional recording device. Some images, the alaising of the image itself interferes with the pseudo borderline in the saw shape, resulting in degradation in image quality. This problem is especially remarkable when high-resolution imagers or dot half-tone images are printed.

Moreover, no matter what type of saw-shaped border is used, when impact positions are undesirably separated from adjacent impact positions, then a line extending along the saw-shaped border appears. Although the saw-shaped line is less likely noticed compared with the straight line, the saw-shaped line appeared in all black images will be distinct.

SUMMARY OF THE INVENTION

It is an object of the present invention to overcome the above problems, and also to provide a line printing type ink jet printer capable of forming high quality images without uneven ink density causing white or black density.

In order to achieve the above and other objectives, there is provided an ink jet recording device including a head, an electric field generating means, an instructing means, and a signal processing means. The head is formed with a plurality of nozzles aligned in a first direction, and selectively ejects ink droplets from the nozzles in response to an ejection data to form an image on a recording medium. The electric field generating means generates a charger electric field for charging the ink droplets and a charger electric field for deflecting a flying direction of the charged ink droplets in response to a deflection data. The electric field generating means includes an electrode provided common to the plurality of nozzles and extending in the first direction. The instructing means outputs an instruction indicating an overlapping manner of a plurality of dots of ink droplets ejected from different nozzles to form a single dot. The signal processing means generates the ejection data and the deflection data based on the instruction from the instructing means.

There is also provided an ink jet recording device including a head, deflecting means, a moving unit, an instructing means, and a signal processing means. The head is formed with a plurality of nozzles aligned in a first direction, and selectively ejects ink droplets from the nozzles onto a recording medium in response to ejection data. The deflecting means deflects a flying direction of the ejected ink droplets toward a second direction perpendicular to the first direction in response to deflection data. The moving unit relatively moves the recording medium in a third direction angled from the first direction. The instructing means instructs an overlapping manner of dots of a plurality of ink droplets for forming a single dot. The signal processing means generates the ejection data and the deflection data based on the instruction from the instructing means.

BRIEF DESCRIPTION OF THE DRAWINGS

The above and other objects, features and advantages of the present invention will become more apparent from the following description when taken in conjunction with the accompanying drawings, in which:

FIG. 3(*b*) is a plan view showing the ejection surface of the recording head;

FIG. 8(*a*) is an explanatory view showing a dot period and a deflected-dot period;

FIG. 8(*b*) is a table showing ejection data;

FIG. 8(*c*) is an explanatory view showing change in magnitude of a deflector electric field;

FIG. 8(*d*) is an explanatory view showing a positional relationship between an orifice and an impact position of a deflected ink droplet;

FIG. 8(*e*) is an explanatory view showing a positional relationship between an orifice and an impact position of a deflected ink droplet;

FIG. 8(*f*) is an explanatory view showing a positional relationship between an orifice and an impact position of a deflected ink droplet;

FIG. 8(*g*) is an explanatory view showing a positional relationship between an orifice and an impact position of a deflected ink droplet;

FIG. 12(*a*) is an explanatory view of change in ink density with respect to the x direction;

FIG. 12(*b*) is an explanatory view of change in ink density with respect to the y direction;

FIG. 13(*a*) is an explanatory view of impact positions according to a first modification of the embodiment;

FIG. 13(*b*) is an explanatory view of impact positions according to a second modification of the embodiment;

FIG. 13(*c*) is an explanatory view of impact positions according to a third modification of the embodiment;

FIG. 14(*b*) is an explanatory view of impact position according to a modification of the second embodiment.

PREFERRED EMBODIMENT OF THE PRESENT INVENTION

Next, an embodiment of the present invention will be described while referring to the accompanying drawings.

First, overall configuration of the line-scanning-type multi-nozzle ink jet recording device 1 will be described while referring to FIG. 1.

Figure 1:
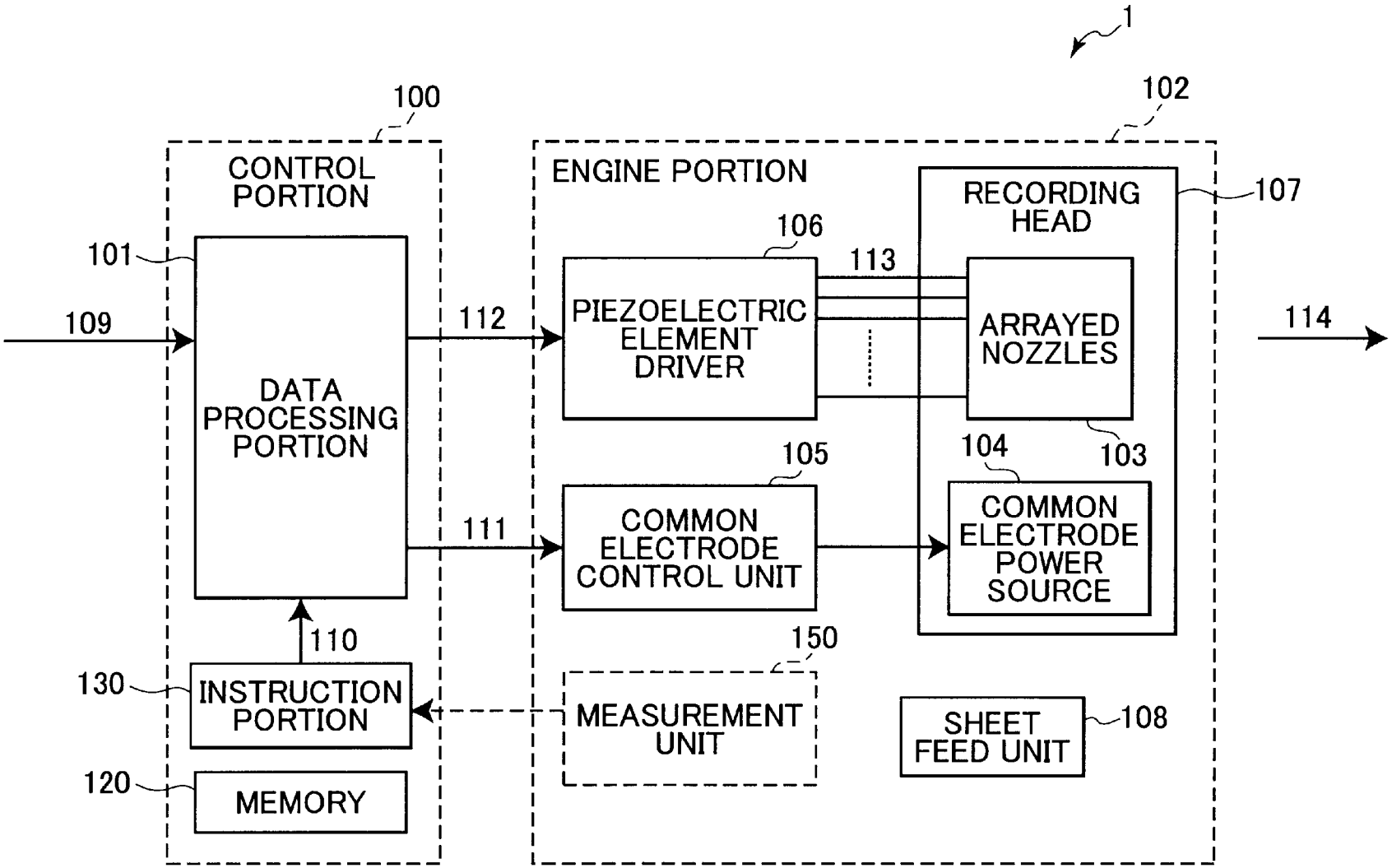
FIG. 1 is a block diagram showing a configuration of multinozzle ink jet recording device according to an embodiment of the present invention.
Figure 2:
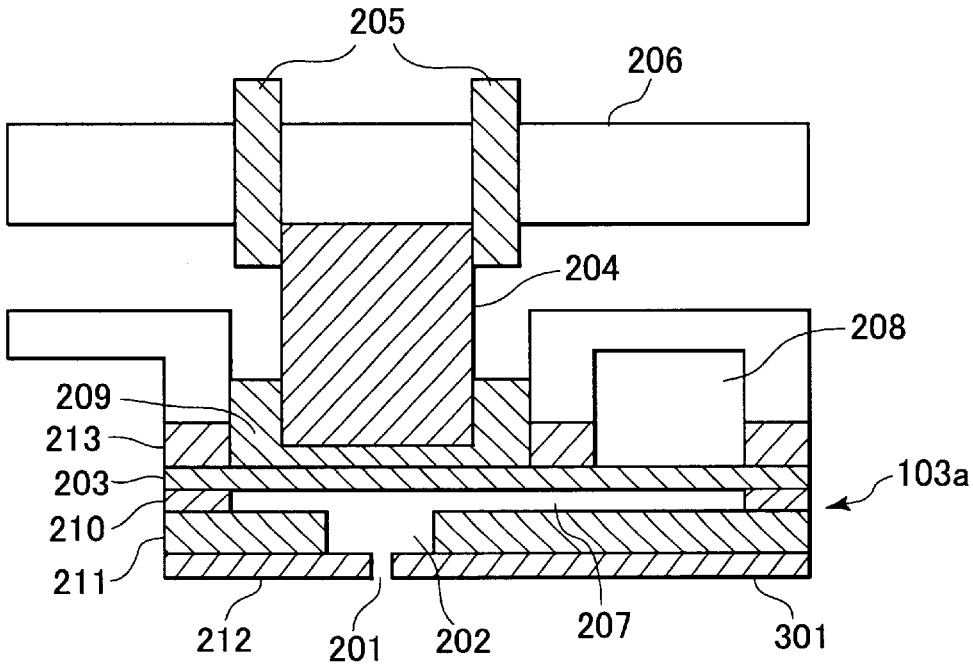
FIG. 2 is a cross-sectional view of a nozzle formed in recording head of the ink jet recording device of FIG. 1.

As shown in FIG. 1, the ink jet recording device 1 includes a control portion 100 and an engine portion 102. The engine portion 102 includes a common electrode control unit 105, a piezoelectric-element driver 106, a recording head 107, and a sheet feed unit 108. The recording head 107 includes arrayed nozzles 103 and a common-electrode power source 104. Each of the arrayed nozzles 103 includes a plurality of nozzles 103 a (FIG. 2). The common-electrode power source 104 applies voltages to common electrodes 401, 402 shown in FIG. 4. Because the piezoelectric-element driver 106 has a well-known configuration, detailed description thereof will be omitted.

When the ink jet recording device 1 is a full-color recording device, a plurality of recording heads 107 are provided for a plurality of different colored ink. However, in the present embodiment, it is assumed that the ink jet recording device 1 is a monochromatic recording device, and that only one recording head 107 is provided.

The control portion 100 includes a data processing portion 101, a memory 120, and an instruction portion 130. The data processing portion 101 receives a bitmap data 109, which is binary data, from an external computer and the like (not shown). The instruction portion 130 outputs an instruction 110 to the data processing portion 101, the instruction 110 indicating an overlapping manner of dots (described later). It should be noted that the instruction 110 can be input from the external computer instead. When the ink jet recording device 1 is the full-color recording device, a plurality of sets of the bitmap data 109 are usually provided for the recording heads 107.

Upon receipt of the bitmap data 109, the data processing portion 101 generates ejection data 112 for each of the arrayed nozzle 103 of the recording head 107 and electrode data 111 for the common-electrode power source 104 of the recording head 107, based on the bitmap data 109. The ejection data 112 and the electrode data 111 are generated based also on position information of each arrayed nozzles 103 and deflection information of ink droplets. Various programs for a plurality of overlapping manners (described later) are stored in the memory 120. The instruction 110 indicates selected one of the programs, and the ejection data 112 and the electrode data 111 is generated in accordance with the selected program. The overlapping manner indicates how much and in which direction to overlap a plurality of dots to form a single dot. Details will be described later.

The generated ejection data 112 is binary data indicating "1" for ink ejection and "0" for non-ejection, which is arranged in an order to be used. The data processing portion 101 temporarily stores one-scanning-worth or one-page-worth of the ejection data 112. The electrode data 111 is generated in accordance with the deflection information, and indicates the order of voltages that the common-electrode power source 104 applies to common electrodes 401, 402. The electrode data 111 is in synchronization with the ejection data 112, and is a repeated pattern of data corresponding to a deflection number n. For example, when the deflection number n=4, then the pattern will have four sets of data of "R2", "R1", "L1", "L2 ". Being in synchronization with the ejection data 112, the electrode data 111 will be, for example, "R2, R1, L1, L2, R2, R1, L1 . . . and on" or "R1, R2, L2, L1, R1, R2, . . . and on", which are periodically repeated pattern of four data sets. The data processing portion 101 stores a single-period worth of the electrode data 111.

When the printing is started, the sheet feed unit 108 starts feeding a recording sheet. At the same time, the common electrode control unit 105 receives the electrode data 111 from the data processing portion 101, and controls the common-electrode power source 104 to apply a corresponding voltage to the common electrodes 401, 402. The common electrodes 401, 402 generate, in a manner described later, a charger electric field and a deflector electric field, both are common to all nozzles 103*a* included in respective arrayed nozzles 103. When a recording position of the recording sheet reaches the recording head 107, the data processing portion 101 outputs the ejection data 112 to the piezoelectric-element driver 106, and the piezoelectric-element driver 106 in return outputs a drive signal 113 to each arrayed nozzles 103. As a result, ink droplets are ejected from the arrayed nozzles 103. Thus ejected droplets are charged by the charger electric filed, and their flying direction is deflected by the charger electric field, which is maintained constant. Then, the ink droplets impact and form an ink image 114 on the recording sheet.

It should be noted that in the ink jet recording device 1 of the present embodiment, printing is performed by the recording head 107 that is held still while the recording sheet is transported. However, the present invention can be also applied to a printer where the printing is performed while a recording head is moving and a recording sheet is being held still.

Next, detailed descriptions for the engine portion 102 will be provided.

FIG. 2 shows a configuration of the arrayed nozzles 103 of the recording head 107. As shown in FIG. 2, each nozzle 103*a* of the arrayed nozzles 103 includes a diaphragm 203, a piezoelectric element 204, a signal input terminal 205, a piezoelectric element supporting substrate 206, a restrictor plate 210, a pressure-chamber plate 211, an orifice plate 212, and a supporting plate 213. The diaphragm 203 and the piezoelectric element 204 are attached to each other by a resilient member 209, such as silicon adhesive. The restrictor plate 210 defines a restrictor 207. The pressure-chamber plate 211 and the orifice plate 212 define a pressure chamber 202 and an orifice 201, respectively. The orifice plate 212 has an ejection surface 301. A common ink supply path 208 is formed above the pressure chamber 202 and is fluidly connected to the pressure chamber 202 via the restrictor 207. Ink flows from above to below through the common ink supply channel 208, the restrictor 207, the pressure chamber 202, and the orifice 201. The restrictor 207 regulates an ink amount supplied into the pressure chamber 202. The supporting plate 213 supports the diaphragm 203. The piezoelectric element 204 deforms when a voltage is applied to the signal input terminal 205, and maintains its initial shape when no voltage is applied.

The diaphragm 203, the restrictor plate 210, the pressure-chamber plate 211, and the supporting plate 213 are formed from stainless steel, for example. The orifice plate 212 is formed from nickel material. The piezoelectric element supporting substrate 206 is formed from an insulating material, such as ceramics and polyimide.

The drive signal 113 from the piezoelectric-element driver 106 is input to the signal input terminal 205. In accordance with the drive signal 113, uniform ink droplets separated from each other are ejected, ideally outwardly with respect to a normal line of the orifice plate 212, from the orifice 201.

Figure 3A:
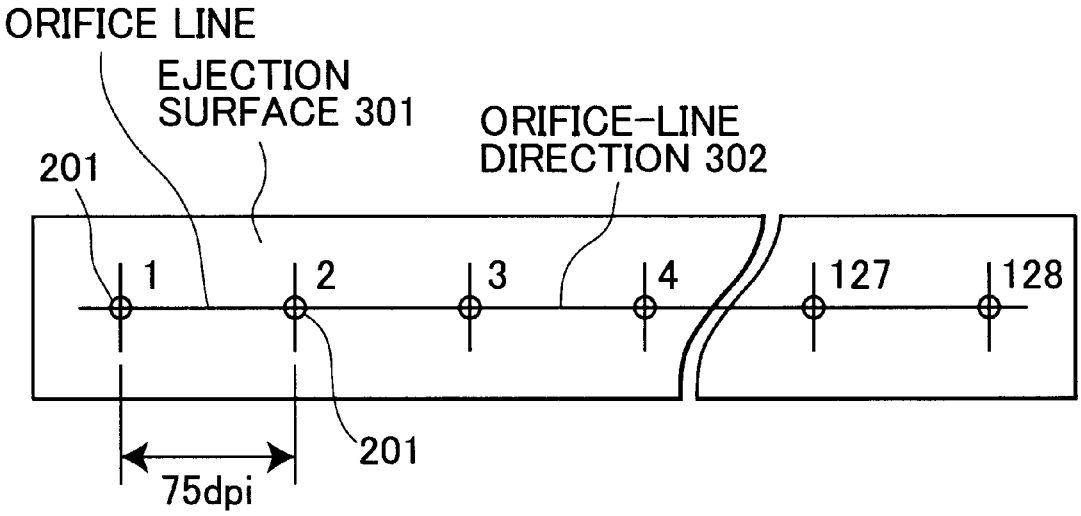
FIG. 3(*a*) is a plan view partially showing an ejection surface of the recording head.
Figure 3B:
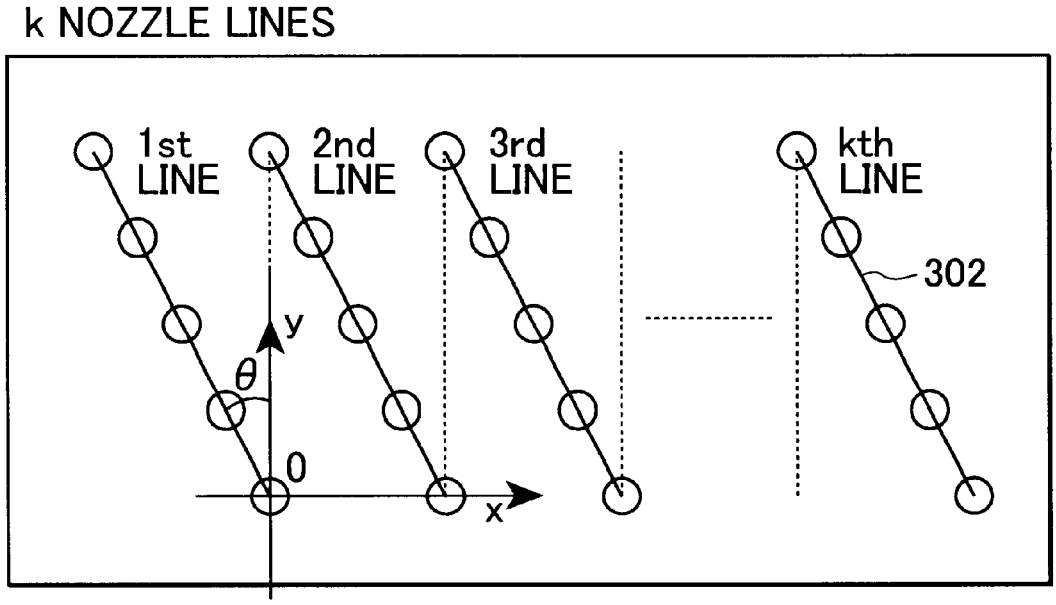

As shown in FIG. 3(*b*), a plurality of arrayed nozzles 103 are formed to the recording head 107. Details will be described below.

As shown in FIG. 3(*b*), the ejection surface 301 is formed with a plurality of arrayed nozzles 103 arranged side by side in an x direction and each extending in an orifice-line direction 302, which is inclined by θ with respect to a y direction perpendicular to the x direction. As shown in FIG. 3(*a*), each arrayed nozzle 103 includes 128 orifices 201 arranged at a pitch of 75 orifices/inch in the orifice-line direction 302. Although not indicated in the drawings, adjacent arrayed nozzles 103 are usually overlap each other in the x direction by several-dot-worth amount. This arrangement prevents unevenness in ink density of recorded image, which appears in a black or white band shape, due to erroneous attachment or uneven nozzle characteristics, and also enables assembly of a recording head elongated in the x direction.

Figure 4:
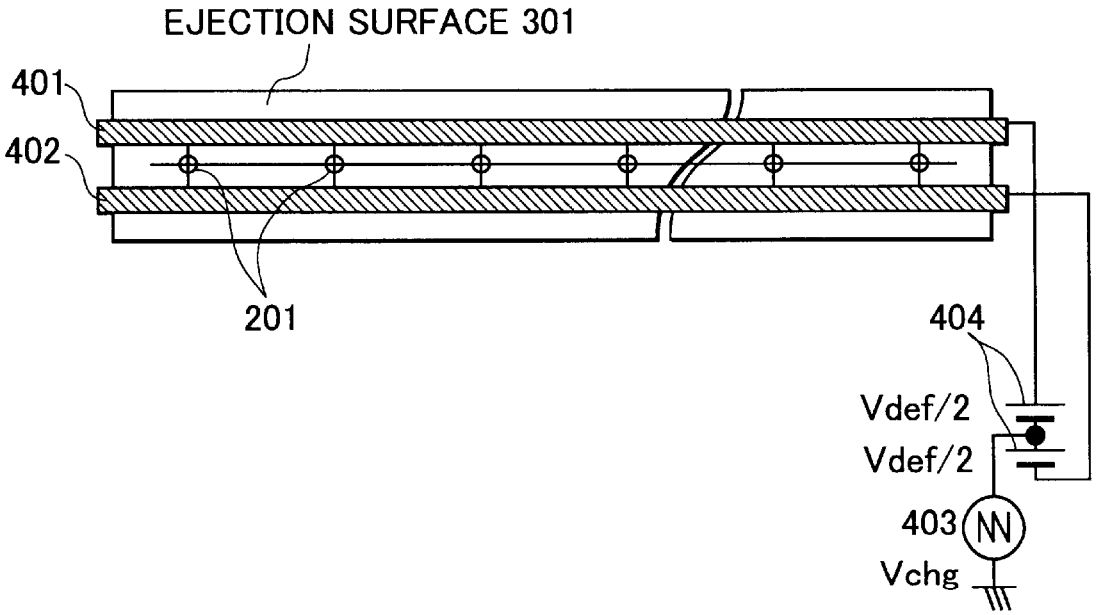
FIG. 4 is an explanatory plan view showing the ejection surface and common electrodes.
Figures 5, 6:
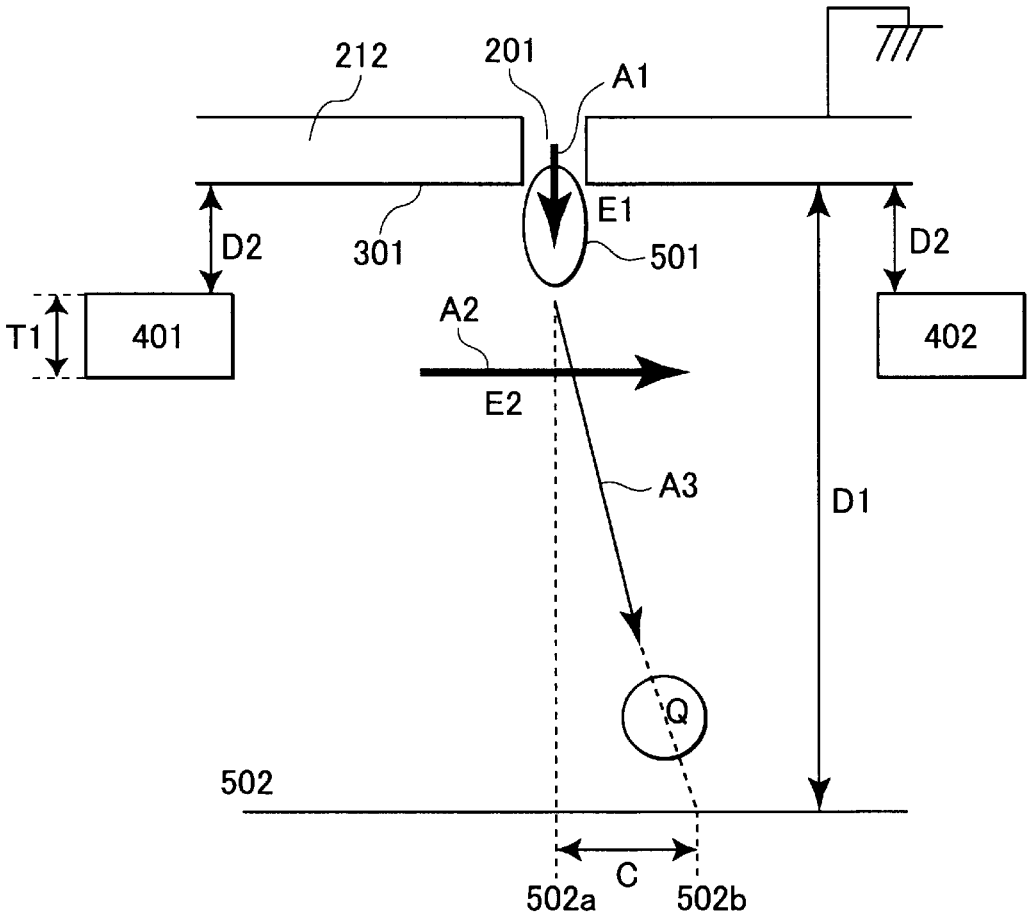
FIG. 5 is an explanatory cross-sectional view showing ink droplet deflection.
FIG. 6 is a table indicating deflection results.

As shown in FIGS. 4 and 5, the common electrodes 401, 402 are provided for each arrayed nozzles 103, at positions between the ejection surface 301 and a recording sheet 502. The common electrodes 401, 402 extend parallel to the nozzle line 302 and sandwich the corresponding arrayed nozzles 103. In the present embodiment, a distance D1 from the orifice plate 212 to the recording sheet 502 is 1.6 mm. A distance D2 from the orifice plate 212 to the common electrode 401 (402) is 0.3 mm. Each common electrode 401, 402 has a thickness T1 of 0.3 mm. The common electrodes 401 and 402 are separated from each other by a distance of 1 mm.

As shown in FIG. 3, the common-electrode power source 104 includes an alternate current (AC) power source 403 and a pair of direct current (DC) power sources 404. The AC power source 403 outputs an electric voltage Vchg. As will be described later, the value of the electric voltage Vchg is changed among several different values in a predetermined frequency. Each of the DC power sources 404 outputs an electric voltage Vdef/2. With this configuration, an electric voltage of Vchg+Vdef/2 and Vchg−Vdef/2 are applied to the common electrodes 401 and 402, respectively. The orifice plate 212 having the ejection surface 301 is connected to the ground.

As shown in FIG. 5, the common electrodes 401, 402 and the orifice plate 212 together generate a charger electric field E1 in a region near the orifice 201. Because the orifice plate 212 is conductive and connected to the ground, the direction of the charger electric field E1 is parallel to the normal line of the orifice plate 212 as indicated by an arrow A1. The common electrodes 401 and 402 also generate a deflector electric field E2 having a direction from the common electrode 401 to the common electrode 402 as indicated by an arrow A2. That is, the deflector electric field E2 has the direction A2 perpendicular to the orifice-line direction 302. The magnitude of the deflector electric field E2 is in proportion to the electric voltage Vdef. The electric voltage Vdef is maintained at 400 V in this embodiment.

Because the orifice 201 is separated from both the electrodes 401 and 402 by the same distance, the electric voltage applied to an ink droplet 501, which is about to be ejected, is in proportion to the electric voltage Vchg. Accordingly, at the time of ejection, the ink droplet 501 is charged with a voltage of Q in a polarity opposite to the electric voltage Vchg and in a magnitude in proportion to the Vchg. In this way, the electric field E1 charges the ink droplet 501.

After ejection, the flying speed of the ink droplet 501 is accelerated by the charger electric field E1. When the ink droplet 501 reaches between the common electrodes 401 and 402, the deflector electric field E2 deflects the ink droplet 501 toward the direction A2 of the electric field E2 and changes its flying direction to a direction indicated by an arrow A3. Then, the ink droplet 501 impacts on the recording sheet 502 at a position 502*b* shifted in the direction A2 by a distance C from an original position 502*a* where the ink droplet 501 would have impacted if not deflected at all. The distance C between the actual impact position 502*b* and the original position 502*a* is referred to as deflection amount C hereinafter.

FIG. 6 shows a table indicating the relationships among the deflection amounts C (μm) and average flying speeds Vav (m/sec) obtained when the DC voltage Vchg are 200 V, 100 V, 0 V, −100 V, and −200 V. The-average flying speed Vav indicates an average flying speed of the ink droplet 501 from when the ink droplet 501 is ejected from the orifice 201 until impacts on the recording sheet 502.

It should be noted that a flying time T from when the ink droplet 501 is ejected until when impacts on the recording sheet 502 is ignored in the explanation. This is because fluctuation in the deflection amount C during actual printing hardly varies the flying time T. A possible explanation for this is that when the deflection amount C is relatively large, a flying distance of the ink droplet 501 increases. However, in this case, the charging amount Q also increases, and this in turn increases acceleration rate cased by the charger electric field E1 and the deflector electric field E2, thereby increasing the average speed Vav of the ink droplet 501. Accordingly, the flying time T stays unchanged regardless of the deflection amount C.

Next, an x-y coordinate system used in this embodiment will be described while referring to FIG. 7. The x-y coordinate system is defined on the recording sheet 502, and includes a plurality of x-scanning lines 702 and a plurality of y-scanning lines 701. The x-scanning lines 702 extend in the x direction and align at a uniform interval of dy in the y direction, which is referred to as "resolution interval dy". On the other hand, the y-scanning lines 701 extend in the y direction and align at a uniform interval of dx in the x direction, which is referred to as "resolution interval dx". These x-scanning lines 702 and y-scanning 701 lines intersect one another and define a plurality of grids 704 having grid corners 704*a*. The ink droplets 501 are controlled to impact on one of grid corners 704*a*, which is defined by a coordinate value (dx, dy). It should be noted that in the present embodiment, the recording sheet 502 is moved in the y direction during printing.

In the present embodiment, the recording head 107 is positioned above the recording sheet 502 while its ejection surface 301 faces and extends parallel to the recording sheet 502. The distance between the recording sheet 502 and the ejection surface 301 is between 1 mm and 2 mm.

Next, a specific example of the present embodiment will be described while referring to FIG. 7. In this example, tan θ is set to ½. Also, the charger electric field E1 takes four different magnitudes, i.e., a deflection number n is 4, so an ink droplet 501 ejected from a single orifice 201 is deflected by one of four deflection amounts C, and impacts on one of four impact positions 703. Because it is desirable not to increase the deflection amount C, the four impact positions 703 are symmetrically arranged to the left and right sides of the orifice 201.

Also, in the present example, two adjacent orifices 201 are separated in the x direction by a single grid 704 (dx). Accordingly, the nozzle interval in the y direction is 2dx (=dx/tan θ). Therefore, a distance between the adjacent orifices 201, i.e., nozzle pitch, is $\sqrt{5\times dx}$.

Because the orifice pitch in the orifice-line direction 302 is set to 75 orifices/inch as described above, the resolution interval dx is 82 μm, so the resolutions of the printed image 114 in the x and y directions are both 309 dpi (1/dx and 1/dy, respectively).

Figure 7:
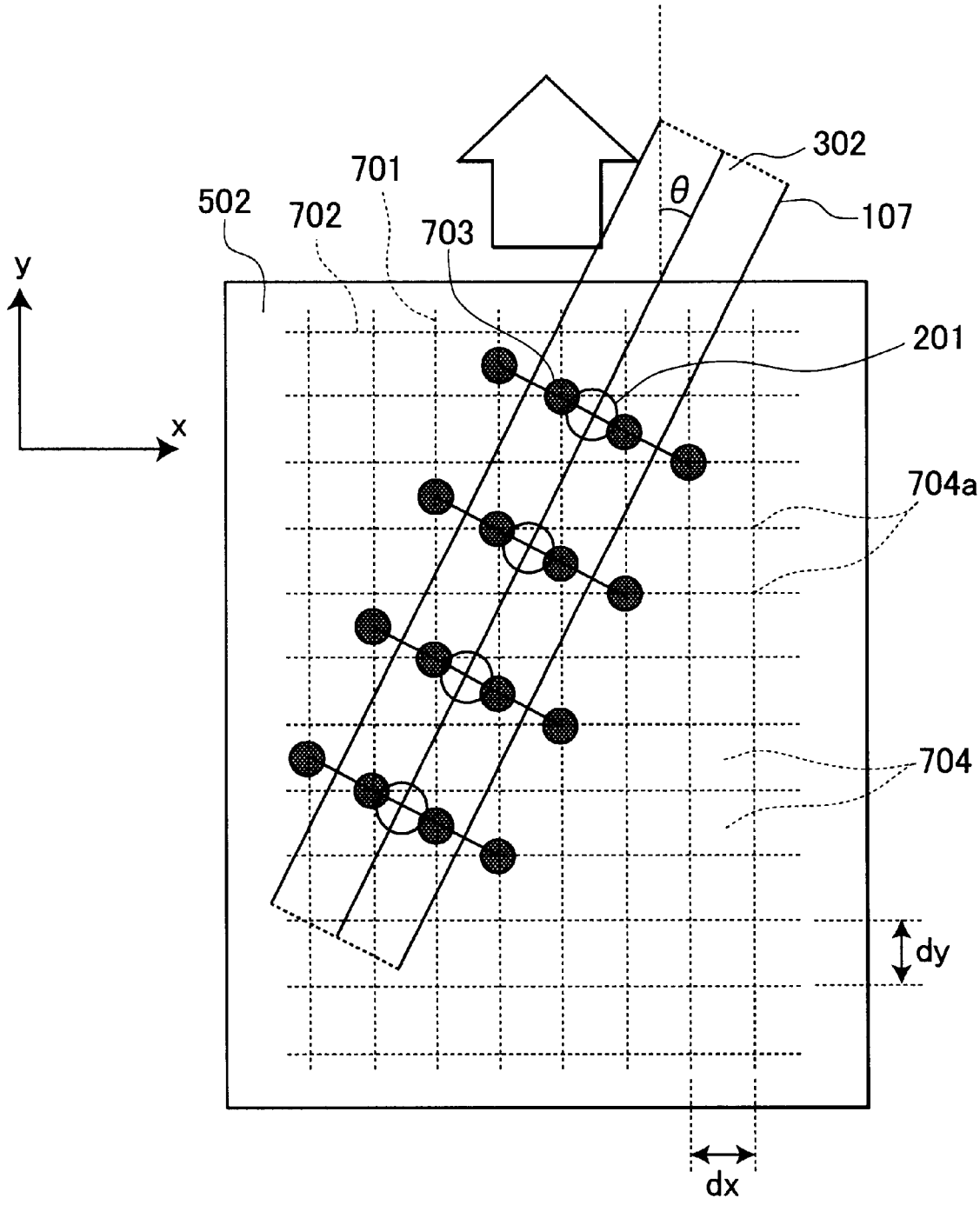
FIG. 7 is an explanatory view showing a partial configuration of engine portion including the recording head.

In FIG. 7, four ink droplets from a single orifice 201 seem to hit on different x-scanning lines 702. However, these droplets are ejected at different timing while the recording sheet 502 moves toward y direction, the impact positions 703 of these four ink droplets will be on the same x-scanning line 702, but on the different grid corners 704*a*.

FIGS. 8(*a*) to 8(*c*) show relationships between the charger electric field E1, the ejection data 112, and the impact positions 703. In FIG. 8(*a*), a sheet-feed time t0, t1, t2, . . . is a time duration required to move the recording sheet 502 by a single-grid-worth of distance in the y direction (1dy), which is referred to as "dot period". The sheet-feed time is further divided into n dot-forming time segments t00, t01, t02, t03, t10, t11, t12, t13, t20, t 21, . . . , which is referred to as "deflected-dot period". In each dot-forming time segment, a single dot is formed by a single nozzle 103*a*. Because the deflection number n is 4 in this example, the dot-forming time segment is ¼ of the sheet-feed time.

Because the flying time T is constant regardless of the deflection amount C as described above, it is unnecessary to take the flying time T (sheet transporting speed) into consideration when determining the ink ejection timing. In actual printing, the recording sheet 502 is moved by a predetermined distance in the y direction while the flying time T. Therefore, it would be only necessary to be aware that all the actual impact positions 703 would shift by a predetermined distance in the y direction. Accordingly, the deflected dot period will be constant in time, and so the maximum frequency in which the nozzles 301*a* can respond can be set to the deflected dot period. As a result, high speed printing can be realized.

Also, the timing of changing the magnitude of the charger electric field E1 is set to the exact time of when the ink droplet 501 is generated, that is, when ink is separated from remaining ink in the nozzle 103*a* and forms a ink droplet 501. In practice, it is preferable to set the actual timing to a time a predetermined time duration after the ejection data 112 is output, that is, after the piezoelectric element is driven. This timing can be obtained through experiments.

Figure 9:
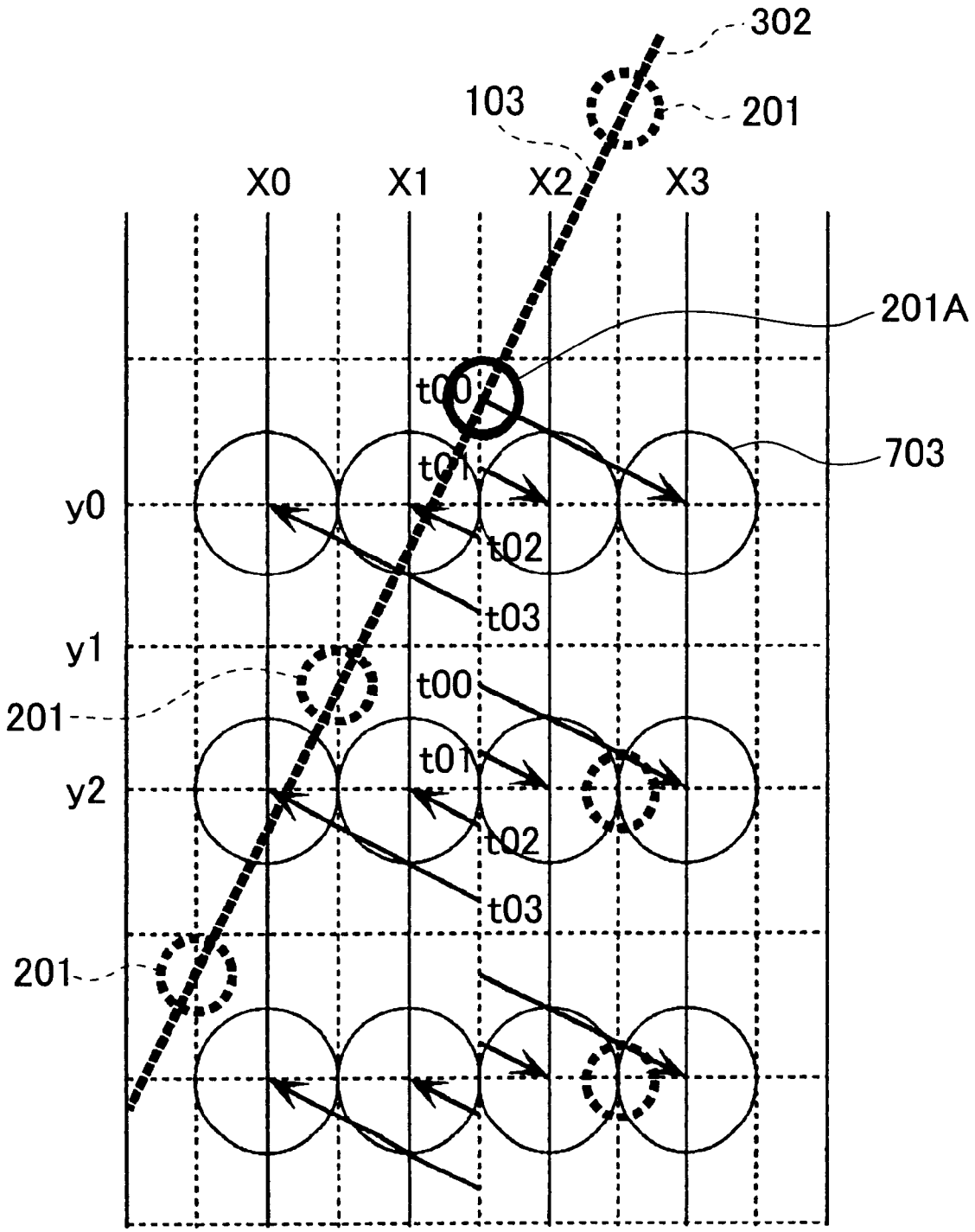
FIG. 9 is an explanatory view showing positional relationships between ejection positions of the orifice and impact positions.

FIG. 9 shows dots (ink droplet impact positions 703 ) formed on the recording sheet 502. Here, the explanation will be provided while focusing an orifice 201A indicated by a solid circle. It is assumed that, in order to show positions of dots on the recording sheet 502, the recording sheet 502 is in stationary, and that the orifices 201, that is, the arrayed nozzles 103, move downward in FIG. 9. FIG. 9 shows positions of the orifice 201A at the time of t00 of FIG. 8(*a*). An ink droplet 501 ejected at the time of t00 from the orifice 201A impact on the position of (x3, y0) as shown in FIG. 8(*d*). Similarly, because the orifice 201A moves to the positions of t01, t02, t03 in FIG. 9 at the time of t01, t02, t03, respectively, ink droplets 501 ejected at the positions of t01, t02, t03 impact on the impact positions of (x2, y0), (x1, y0), (x0, y0), respectively. The same process is repeated thereafter.

Ink droplets 501 are also ejected in the same manner from other nozzles not shown in FIG. 9. Accordingly, although not shown in the drawings, dots that are the same as those shown in FIG. 9 are formed on the recording sheet 502 at the right and left of those shown in FIG. 9. In this case, four ink droplets 501 ejected from different orifices 201 impact on a single impact position 703. That is, a single dot is formed by four ink droplets ejected from different orifices 201. For example, dot on the position of (x2, y0) shown in FIG. 9 will be formed by an ink droplet that is ejected from the orifice 201A and deflected rightward by a single y-scanning line, an ink droplet that is ejected from an orifice at left side of the orifice 201A and deflected rightward by two y-scanning lines, an ink droplet-that is ejected from an orifice at right side of the orifice 201A and deflected leftward by a single y-scanning line, and an ink droplet that is ejected from an orifice two orifices down from the orifice 201A to the left and ejected rightward by two y-scanning lines. This printing method will be referred to as multiple printing by different orifices. This printing method can cancel out uneven characteristics in different nozzles 103*a* and prevent uneven ink density in printed images. Also, even if one of the four nozzles that are allocated to a single dot become defective, only slight unevenness in printing will result, and resultant image will hardly differ from the original one.

As described above, multiple printing by different orifices can provide printed image with uniform ink density. However, this printing method has not much effect on controlling unevenness in impact position.

When a recorded dot is relatively large, which can be provided by increasing the size of the each droplet, there will be less unevenness in ink density. However, in this case, the dark colored portion or fine portion of intermediate-toned image cannot be printed properly, and so the image quality will be degraded. On the other hand, when a recorded dot is relatively small, because four ink droplets for a single dot will sometimes hit on an exact same position, and because four ink droplets for a single dot will sometimes hit on positions slightly shifted from each other, ink density of printed image will be likely uneven.

In order to overcome the above problems, according to the present invention, the center of impact positions, i.e., dots, of four ink droplets for a single dot are intentionally shifted by a slight amount. When the shifting amount is too large, and when one of four nozzles 103*a* for a single dot becomes defective, the resultant image will undesirably differ from the original. Therefore, in the present example, the shifting amount is set to ¼-dot-worth of distance from both the right and the left, that is ½-dot-worth of distance in total. Details will be described next.

Figure 10:
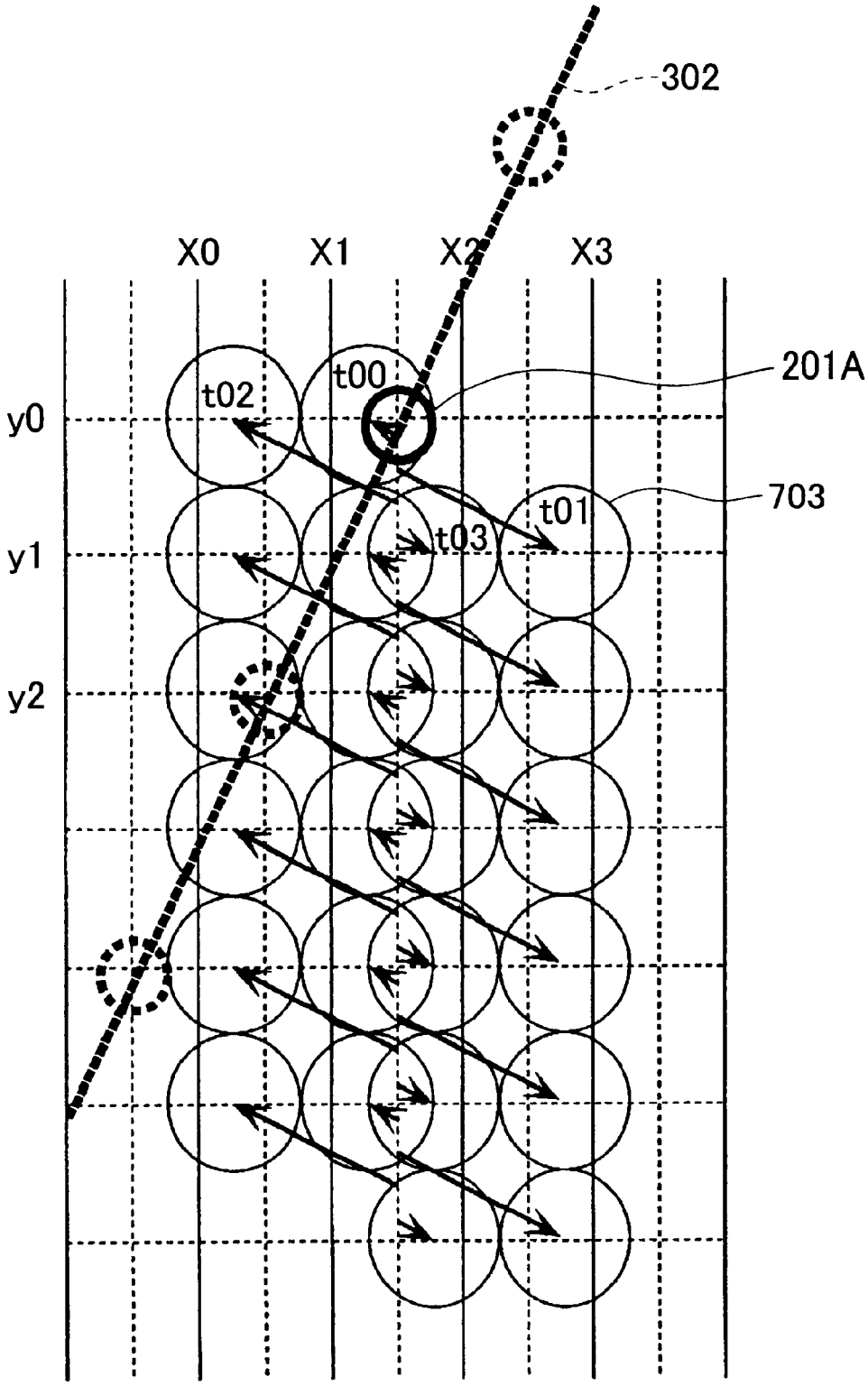
FIG. 10 is an explanatory view showing impact positions in multiple printing, wherein four ink droplets ejected for a single dot are divided into the left and the right.

FIG. 10 shows dots 703 which are recorded by the orifice 201A. In FIG. 10, four ink droplets for a single dot is divided into a right side and a left side, each side having two ink droplets. The ink droplets at the right side are shifted leftward by one fourth of dx (dx/4), and the ink droplets at the left side are shifted rightward by dx/4. The resultant single dot will have an elongated width in x direction. Specifically, the ink droplets ejected at the time of T00, T01, t02, t03 are deflected leftward by dx/4, rightward by dx5/4, leftward by dx5/4, and rightward by dx/4, respectively, and impact on the positions of (x0+dx/4, y0), (x1+dx/4, y0), (x2−dx/4, y1), (x3−dx/4, y1), respectively. The deflection dot period is shortened to half of that of FIG. 8. The same process is repeated thereinafter. It should be noted that the impact positions can be shifted with respect to the x direction by controlling the magnitude of the charger electric filed E1, which is determined by the voltage Vchg.

Figure 11:
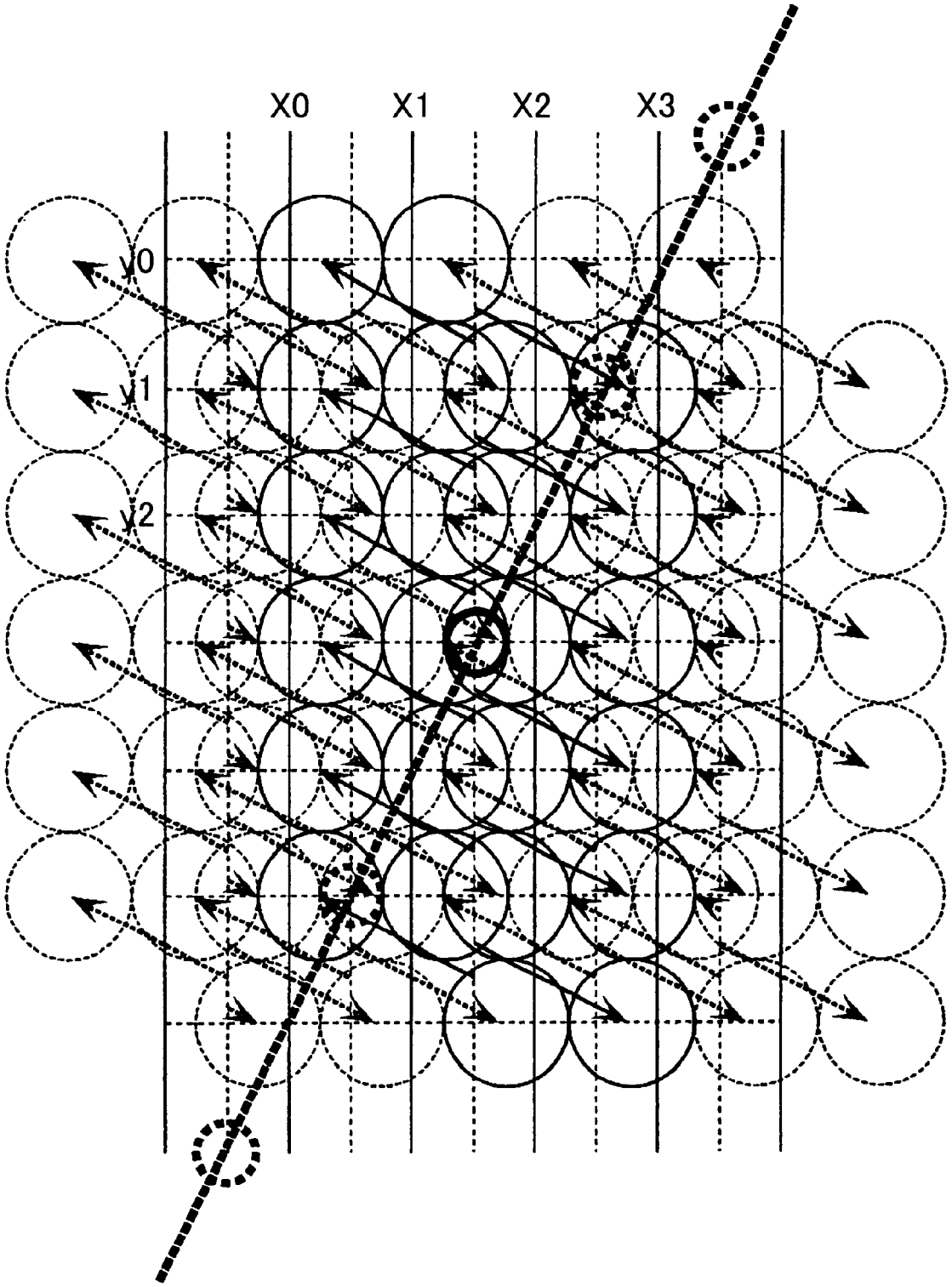
FIG. 11 is an explanatory view showing impact positions of FIG. 10 as well as neighboring impact positions.

FIG. 11 shows the recording sheet 502 with dots that are recorded by the orifice 201A of FIG. 10 and by some of other orifices 201. For example, two ink droplets impacts on the position (x1+dx/4, y1), that is, an ink droplet that is ejected from the orifice 201A and deflected rightward by dx/4 and by an ink droplet that is ejected from an orifice 201 at right side of the orifice 201A and deflected leftward by dx5/4. Similarly, two ink droplets impact on the position (x2−dx/4, y1), that is, an ink droplet that is ejected from the orifice 201A and deflected rightward by dx/4 and an ink droplet that is ejected from an orifice 201 at the left side of the orifice 201A and deflected rightward by dx5/4.

FIG. 12(*a*) shows change in ink density of thus formed single dot with respect to the x direction. Vertical line segments provided on a horizontal line indicate the y-scanning lines 701. FIG. 12(*b*) shows change in ink density of the single dot with respect to the y direction. Vertical line segments provided on a horizontal line indicate the x-scanning lines 702.

In FIG. 12(*b*), because four ink droplets impact on exactly the same position with respect to the y direction, a rectangular density shape appears. This printing method provides desirable clear edge of a printed image. However, when impact positions shift, unevenness of ink density will be undesirably large. Because the shift in impact positions with respect to the y direction less likely occurs compared with the x direction, this printing method is utilized with respect to the y direction.

In FIG. 12(*a*) four ink droplets impact on one another while shifting by 2-dots-worth of distance at maximum. Accordingly, the density shape will have narrower top and wider bottom. This printing method has a good effect on controlling noise element, which has a high special frequency and causes uneven ink density. Because the present invention is for suppressing unevenness in ink density caused by uneven impact positions shifted by less than ½-dot-worth of distance, this printing method is used with respect to the x direction, in which unevenness in ink density appears.

That is, according to the embodiment, the impact position is controlled to shift in a direction in which undesirable line or strip appears, that is, in the x direction in this embodiment, by a minimum but sufficient amount. Accordingly, undesirable lines due to unevenness in ink density can be prevented without degrading image quality at the dark colored portion or fine portion of intermediate-toned image.

Next, a modification of the embodiment will be described while referring to FIG. 13. In this modification, a shifting direction and a shifting amount of the dots are changed in the multiple printing.

In FIG. 13(*a*), the impact positions are controlled with respect to the x direction by an amount of dx/8 toward left or right. This printing method is effective when the impact positions deviate by only a slight amount. In this case, edge portion of the image can be maintained sharp in the x direction.

In FIG. 13(*b*), four ink droplets for a single dot are all controlled in different manner in both the x and y directions. This printing method is used when uneven ink density occurs both in the x and y directions. The impact position can be shifted with respect to the y direction by controlling the ejection timing, i.e., by controlling the ejection data 112. Because the overlapping amount of dots, which together define the single dot, corresponding to the four ink droplets, can be controlled as desired, a large-sized dot can be formed without increasing the size of each droplet. That is, there is no need to consume larger amount of ink. This contrast to conventional printing methods where the volume of each droplet is increased to form a large size dot.

FIG. 13(*c*), the impact positions are shifted in the y direction by ±dx/8. As described above, one of the causes of the undesirable stripes or black or white lines due to uneven ink density appearing on printed images is unevenness in impact positions among nozzles. However, the undesirable stripes or lines also appear when the sheet feed unit 108 is unable to feed the recording sheet 502 at precisely constant speed. In this case, regardless of how precisely an encoder, for example, adjusts the position and orientation of the recording sheet 502, uneven ink density is inevitable. The present modification is useful in such cases.

The above described first through third modification can be achieved by controlling the deflection amount of ink droplets at the deflector electric filed E1 in the same manner described while referring to FIG. 8(*c*). The deflection amount of ink droplets can be controlled by simply changing the ejection data 112 and the electrode data 111 from the data processing portion 101 shown in FIG. 8(*b*), and there is no need to change the configuration of the engine portion 102. As described above, programs corresponding to the overlapping manners of the above-described embodiment and the modifications are stored in the memory 120. Then, in accordance with the instruction 110, the conversion method to convert or generate the ejection data 112 and the electrode data 111 is selected. The conversion methods can be easily changed even during printing.

For example, the ink jet printer prints a test pattern. Unevenness in ink density of the test pattern will appear as strips, so the unevenness in ink density can be detected by detecting the strips by a well-known image-quality measurement device. Based on the detection result, the instruction portion 130 calculates necessary amount and orientation to shift the impact positions, and outputs the instruction 110 suitable for the case. Specifically, one of the programs stored in the memory 120 suitable for the case is selected. Accordingly, a printing system suitable for the nozzle ejection conditions and precision in sheet feed can be realized, and so the high quality printed image can be obtained.

Alternatively, the ink jet recording device 1 can be provided with an image-quality measurement unit 150 as shown in a dotted line in FIG. 1. In this case, the measurement unit 150 outputs the detection result to the instruction portion 130, based on which the instruction portion 130 generates the instruction signal 110.

Next, a second embodiment of the present invention will be described while referring to FIG. 14.

As in the first embodiment shown in FIG. 9, four ink droplets from different orifices 201 are ejected to form a single dot in the second embodiment also, the four ink droplets being ejected in response to the same ejection data 112.

In the present embodiment, the weight of ink droplets is reduced. When four ink droplets are ejected to a single dot, the resultant dot will be black. When one, two, or three of four ink droplets are ejected to a single dot, the resultant dot will be half tone color. Needless to say, when no ink droplet is ejected, the resultant dot will be white. That is, one of five color tones can be obtained in each dot, and so a high quality image with multiple tones can be provided. Usually, when three or more color tones, including black and while, can be expressed in a single dot, this is called dot multi-tone, and each tone, that is, each ink density level, is called dot-tone level. Therefore, five dot-tone levels can be expressed in the present embodiment.

When the four ink droplets are ejected for a single dot in the same manner as shown in FIG. 9, the resultant dot will have the five dot-tone levels. However, when the magnitude of the charger electric field E1 and the ejection timings are changed to change the overlapping amount and to shift the impact positions in the same manner as that shown in FIG. 13, the number of the dot-tone levels can be increased.

Figures 14A, 14B:
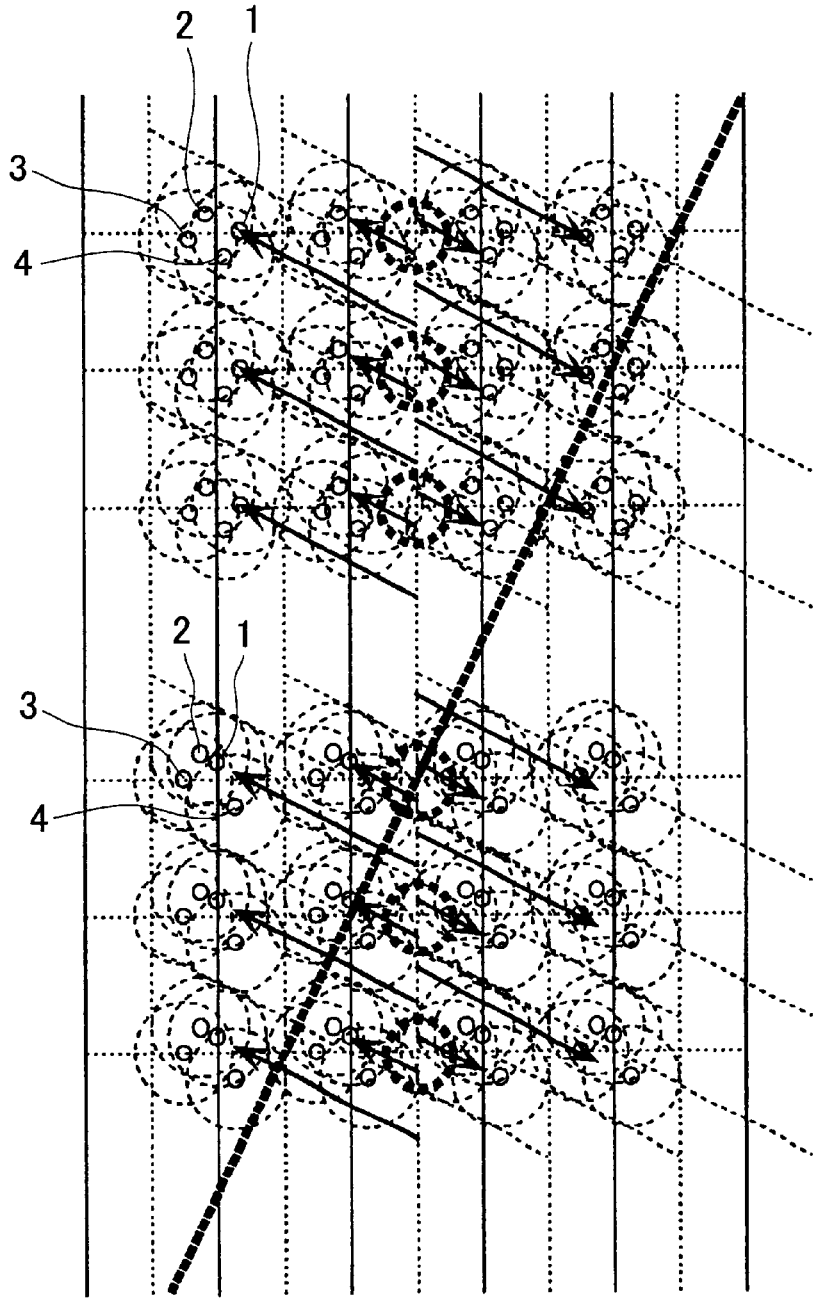
FIG. 14(*a*) is an explanatory view of impact position according to a second embodiment of the present invention.

FIG. 14 shows a specific example. FIG. 14(*a*) is the same as FIG. 13(*b*). In this case, one of seven dot-tone levels can be obtained depending on whether no dot is formed, only a dot 1 is formed, dots 1 and 2 are formed, dots 1 and 3 are formed, dots 1 and 4 are formed, dots 1, 2 and 3 are formed, or dots 1, 2, 3, and 4 are formed. Also, as shown in FIG. 14(*b*), when the positions of the dots 1 through 4 are set such that the distance between the centers of two of the dots 1 through 4 differs from a distance between centers of any other two of the dots 1 through 4, the overlapping amount of two of the dots 1 through 4 also differs from the overlapping amount of any other two of the dots 1 through 4. In this case, the number of the dot-tone levels further increases to 16 levels.

According to the above-described second embodiment, because the number of the dot-tone levels that can be expressed in a single dot is increased, even higher multi-tone image can be obtained. Also, because selective ones of a plurality of dot-tone levels can be used, dot multi-tone with desired ink density characteristics can be defined, so a multi-tone image can be precisely generated.

It should be noted that the conventional methods disclosed in Japanese Patent-Application Publication Nos. SHO-55-42836, HEI-2-62243, and HEI-7-117241 can be applied to the present invention for changing the size of dot formed by multiple printing and shifting direction of impact positions, by simply changing the ejection data 112 and the electrode data 111 in accordance with each method.

As described above, according to the present invention, the boundary line at the boundary between the allocated nozzles is recognizable, and the resolution at the boundary region is not degraded, and the image quality even at the boundary region is maintained. When high-resolution image is printed, or when dot halftone image is printed, no additional process is required.

Also according to the present invention, even when the impact positions of droplets from adjacent two nozzles are separated by an increased amount, a white line does not appear therebetween, but only the ink density decreases. Accordingly, even when an all black image is printed, the quality of the image is not degraded.

Further, according to the present invention, overlapping manner of recorded dots, that is, the overlapping amount and the shifting direction, can be changed in accordance with the direction in which unevenness in ink density, such as undesirable stripes, appears, without degrading the image quality with respect to the direction in which no uneven ink density appears. That is, only the uneven ink density is suppressed while maintaining overall image quality.

While some exemplary embodiments of this invention have been described in detail, those skilled in the art will recognize that there are many possible modifications and variations which may be made in these exemplary embodiments while yet retaining many of the novel features and advantages of the invention.

Also, the present invention can be also applied to an ink jet recording device where printing is performed while a recording head is moved and a recording sheet stays still rather than where the printing is performed while the recording sheet is moved and the recording sheet stays still.

Further, the present invention can also be applied to bubble jet recording device where an air bubble is generated by applying head, and ejecting ink by utilizing the pressure of the generated air bubble.

Although the arrayed nozzle of the above embodiment includes 128 orifices arranged at a pitch of 75 orifices/inch. However, the arrayed nozzle can includes any number of orifices other than 128. Also, the pitch is not limited to 75. A pitch of 150 can be used for example. In this case, the resolution will be twice of the above embodiment.

Moreover, although the data processing portion 101, the instruction portion 130, and the memory 120 are described as separate components in the above embodiments, there can be provided with a data processing unit, which is a microcomputer including functions equivalent to the data processing portion 101, the instruction portion 130, and the memory 120, so that the instruction portion 130 and the memory 120 can be dispensed with. When bitmap data appended with a command and data indicating an overlapping manner of dots is input to the data processing unit, the appending data is stored in a predetermined portion of its internal memory, and the data processing unit generates electrode data and ejection data based on the appending data. In this case, the data processing unit serves as both an instructing means for outputting an instruction indicating an overlapping manner of a plurality of dots and as a signal processing means.

What is claimed is:

1. An ink jet recording device comprising:

a head formed with a plurality of nozzles aligned in a first direction, the head selectively ejecting ink droplets from the nozzles in response to an ejection data to form an image on a recording medium;

an electric field generating means for generating a charger electric field for charging the ink droplets and a charger electric field for deflecting a flying direction of the charged ink droplets in response to a deflection data, the electric field generating means including an electrode provided common to the plurality of nozzles, the electrode extending in the first direction;

an instructing means for outputting an instruction indicating an overlapping manner of a plurality of dots of ink droplets ejected from different nozzles to form a single dot; and a signal processing means for generating the ejection data and the deflection data based on the instruction from the instructing means.

2. The ink jet recording device according to claim 1, wherein the signal processing means generates the ejection data and the deflection data based further on bitmap data from an external device.

3. The ink-jet recording device according to claim 1, wherein the overlapping manner indicates an overlapping amount and an overlapping direction of the dots of the plurality of ink droplets.

4. The ink jet recording device according to claim 1, wherein the instructing means includes a detection means for detecting an unevenness in ink density of the image and a generating means for generating the instruction based on a detected result.

5. The ink jet recording device according to claim 4, wherein the detection means detects a direction of a stripe appearing on the image due to the unevenness in ink density, and the generating means generates the instruction based on the detected direction of the stripe.

6. The ink jet recording device according to claim 1, further comprising a memory that stores a plurality of programs for a plurality of overlapping manners, and the instructing means outputs the instruction indicating one of programs to use.

7. The ink jet recording device according to claim 6, wherein the programs stored in the memory indicate combinations of an overlapping amount and an overlapping direction of the dots of the plurality of ink droplets.

8. The ink jet recording device according to claim 6, wherein the signal processing means switches the programs to use during printing operation.

9. The ink jet recording device according to claim 1, wherein a distance between centers of two of the dots of the plurality of ink droplets that forms the single dot differs from a distance between centers of any other two of the dots.

10. The ink jet recording device according to claim 9, wherein the single dot formed of the dots of the plurality of ink droplets expresses three or more dot-tone levels.

11. An ink jet recording device comprising:

a head formed with a plurality of nozzles aligned in a first direction, the head selectively ejecting ink droplets from the nozzles onto a recording medium in response to ejection data;

a deflecting means for deflecting a flying direction of the ejected ink droplets toward a second direction perpendicular to the first direction in response to deflection data;

a moving unit for relatively moving the recording medium in a third direction angled from the first direction;

an instructing means for instructing an overlapping manner of dots of a plurality of ink droplets for forming a single dot; and a signal processing means for generating the ejection data and the deflection data based on the instruction from the instructing means.

12. The ink jet recording device according to claim 11, wherein the overlapping manner indicates an overlapping amount and an overlapping direction of the dots of the plurality of ink droplets.

13. The ink jet recording device according to claim 11, further comprising a memory that stores a plurality of programs for a plurality of overlapping manners, and the instructing means outputs the instruction indicating one of programs to use.

14. The ink jet recording device according to claim 13, wherein the signal processing means switches the programs to use during printing operation.

15. The ink jet recording device according to claim 11, wherein a distance between centers of two of the dots of the plurality of ink droplets that forms the single dot differs from a distance between centers of any other two of the dots.

16. The ink jet recording device according to claim 15, wherein the single dot formed of the dots of the plurality of ink droplets expresses three or more dot-tone levels.

* * * * *